United States Patent [19]

Senior et al.

[11] Patent Number: 5,062,357

[45] Date of Patent: Nov. 5, 1991

[54] PNEUMATIC PRESS

[75] Inventors: Robert B. Senior, Holland; Edward L. Hvizdos, Fruitport, both of Mich.

[73] Assignee: Innovated, Inc., Holland, Mich.

[21] Appl. No.: 514,672

[22] Filed: Apr. 25, 1990

[51] Int. Cl.[5] ..... B30B 15/16; B30B 1/00

[52] U.S. Cl. ..... 100/53; 72/453.12; 83/165; 83/588; 83/639.1; 83/859; 92/117 A; 100/257; 100/259; 100/266; 100/269 R; 100/299; 181/200

[58] Field of Search ..... 100/53, 214, 257, 259, 100/268, 266, 269 R, 299; 83/639.1, 588, 589, 590, 859, 165; 72/453.12, 453.09, 456; 92/117 R, 117 A; 181/198, 200, 211

[56] References Cited

U.S. PATENT DOCUMENTS

| | | | |
|---|---|---|---|
| 470,435 | 3/1892 | Morris et al. | 83/530 |
| 1,008,528 | 11/1911 | Cruse | 100/266 X |
| 1,113,297 | 10/1914 | Bernauer | 100/266 X |
| 1,894,156 | 1/1933 | Byington | 100/266 X |
| 2,310,890 | 2/1943 | Brandes | 100/268 |
| 2,614,488 | 10/1952 | Purcell | 100/269 R |
| 2,726,707 | 12/1955 | Wellons et al. | 100/257 X |
| 2,766,824 | 10/1956 | Sturtzer | 83/530 |
| 3,158,046 | 11/1964 | Steinfort et al. | 100/269 R X |
| 3,190,215 | 6/1965 | Howard et al. | 100/257 |
| 3,227,022 | 1/1966 | Evans et al. | 83/529 |
| 3,450,037 | 6/1969 | Lickliter et al. | 83/529 X |
| 3,472,109 | 10/1969 | Haas et al. | 100/266 X |
| 3,478,678 | 11/1969 | Lickliter et al. | 100/266 X |
| 3,599,561 | 8/1971 | Reeves | 100/266 X |
| 3,773,140 | 11/1973 | Mahajan et al. | 181/200 |
| 3,822,627 | 7/1974 | Bianchi | 83/529 |
| 3,860,086 | 1/1975 | Mahajan et al. | 181/200 |
| 4,195,565 | 4/1980 | Cordeiro | 100/266 |
| 4,604,930 | 8/1986 | Avila et al. | 100/257 X |

FOREIGN PATENT DOCUMENTS

| | | | |
|---|---|---|---|
| 297493 | 6/1954 | Switzerland | 100/266 |
| 619360 | 8/1978 | U.S.S.R. | 100/269 R |
| 867658 | 9/1981 | U.S.S.R. | 100/269 R |
| 1119857 | 10/1984 | U.S.S.R. | 100/269 R |

OTHER PUBLICATIONS

Equipment Brochure from Airam, 121 East Pine Log Road, Aiken, South Carolina, publication date unknown.

Equipment Brochure dated 1984 from Contour Press Company, 1700 Airpark Drive, Grand Haven, Michigan 49417.

*Primary Examiner*—Harvey C. Hornsby
*Assistant Examiner*—Stephen F. Gerrity
*Attorney, Agent, or Firm*—Varnum, Riddering, Schmidt & Howlett

[57] ABSTRACT

The press has a pneumatically operated piston and cylinder mounted beneath a work plate, and linked to an upper press plate by rods extending through the work plate to provide compression in a die-set area defined between the upper press plate and the work plate. The pneumatically operated piston and cylinder are encased within an enclosed base which is insulated. The movable cylinder acts against springs also mounted within the base which cause the press plate to rebound after a pneumatically operated downstroke.

25 Claims, 4 Drawing Sheets

PNEUMATIC PRESS

BACKGROUND OF THE INVENTION

1. Field of the Invention

The present invention relates to a fluid-operated press, and in particular, to a pneumatic press actuated by a combination of a piston and a cylinder for driving a ram plate.

2. Scope of the Prior Art

Fluid-operated presses are used in many applications, e.g., in stamping metal parts. Conventional presses include a ram head mounted for vertical sliding movement on a plurality of vertical guide posts upstanding from the stationary bed. The ram head and the stationary bed typically define a die-set area therebetween. An upper plate is usually secured to the upper ends of the guideposts to maintain the latter in vertical alignment, thereby permitting free sliding movement of the ram plate.

In certain instances, the ram head is fluid actuated by a piston and cylinder arrangement located above the upper plate with a piston rod extending therethrough to drive the ram head downwardly into the die-set area, the ram head being mechanically returned by springs or the like. In other arrangements such as that disclosed in U.S. Pat. No. 3,450,037 to Lickliter et al., a piston and cylinder operable at low pressures is arranged between the upper plate and the ram head to directly drive the ram head.

It is also known to use an air bladder arranged between the upper plate and the ram head to directly drive the ram head instead of a piston and cylinder. Such equipment is typically adapted to be operated at high speed, providing repetitive reciprocations of several hundred per minute.

Existing pneumatic presses typically operate at a very high noise level, with significant vibration and consequent wear on the parts. Moreover, the pneumatic hydraulic drive equipment and the return springs are typically provided above the work surface which necessarily contributes a significant height to the equipment. If there is a jam at the work surface, the difficult and laborious process of disassembling all of the equipment above the work surface adds significant cost to operating the equipment. Furthermore, the exposed return springs and other operating parts above the work surface present a risk of injury to the operator.

SUMMARY OF THE INVENTION

The present invention is directed to a fluid-operated press for continual stamping. In one aspect of the invention, the press is characterized by a bed plate having an aperture, a discharge hole, a first surface, and a second surface opposite the first surface. A press plate is spaced from the first surface and defines a die-set area therewith. A spring means is provided for biasing the press plate away from the first surface. A pneumatically operated means urges the press plate toward the first surface, and includes a piston mounted to the second surface and a cylinder telescopically received over the piston for reciprocating movement relative thereto. The piston includes an inclined groove in communication with the discharge hole, with the groove sloping away from the discharge hole radially of the piston. Link means connects the cylinder to the press plate and comprises a rod connected at one end to the press plate and at another end to the cylinder with a rod extending through the aperture. Thus, upon introduction and exhaust of pressurized fluid to the cylinder, the cylinder is thereby urged away from and toward, respectively, the second surface, and the press plate is urged toward and away from, respectively, the first surface to repetitively compress a die set positioned in the die-set area.

Preferably, a base supports the bed plate, with the base having walls substantially defining a chamber, and the pneumatically operated means is mounted within the chamber. Sound-deadening means may be provided for damping sound emanating from the chamber when the pressurized fluid is alternately introduced and exhausted from the pneumatically operated means. Typically, the sound-deadening means comprises insulation adjacent the interior surfaces of the walls.

In another aspect of the invention, the bed plate has an aperture, and the link means comprises a rod connected at one end to the press plate at another end to the cylinder with the rod extending through the aperture. The rod is preferably threaded, and the connection between the rod and the press plate comprises a nut and locknut so that the position of the press plate may be adjusted relative to the cylinder. At the other end of the rod, the cylinder has an end wall which extends beyond the radius of the cylinder wall, and the rod is connected to the end wall.

In yet another aspect of the invention, a stop member is mounted to the rod between the bed plate and the press plate to stop movement of the press plate by contacting the first surface as the press plate is urged toward the first surface. Preferably, the stop member comprises a collet threaded onto the rod. A shock-absorbing damper may be provided on the first surface to absorb the impact of the stop member.

DETAILED DESCRIPTION OF A PREFERRED EMBODIMENT

Figure 1:
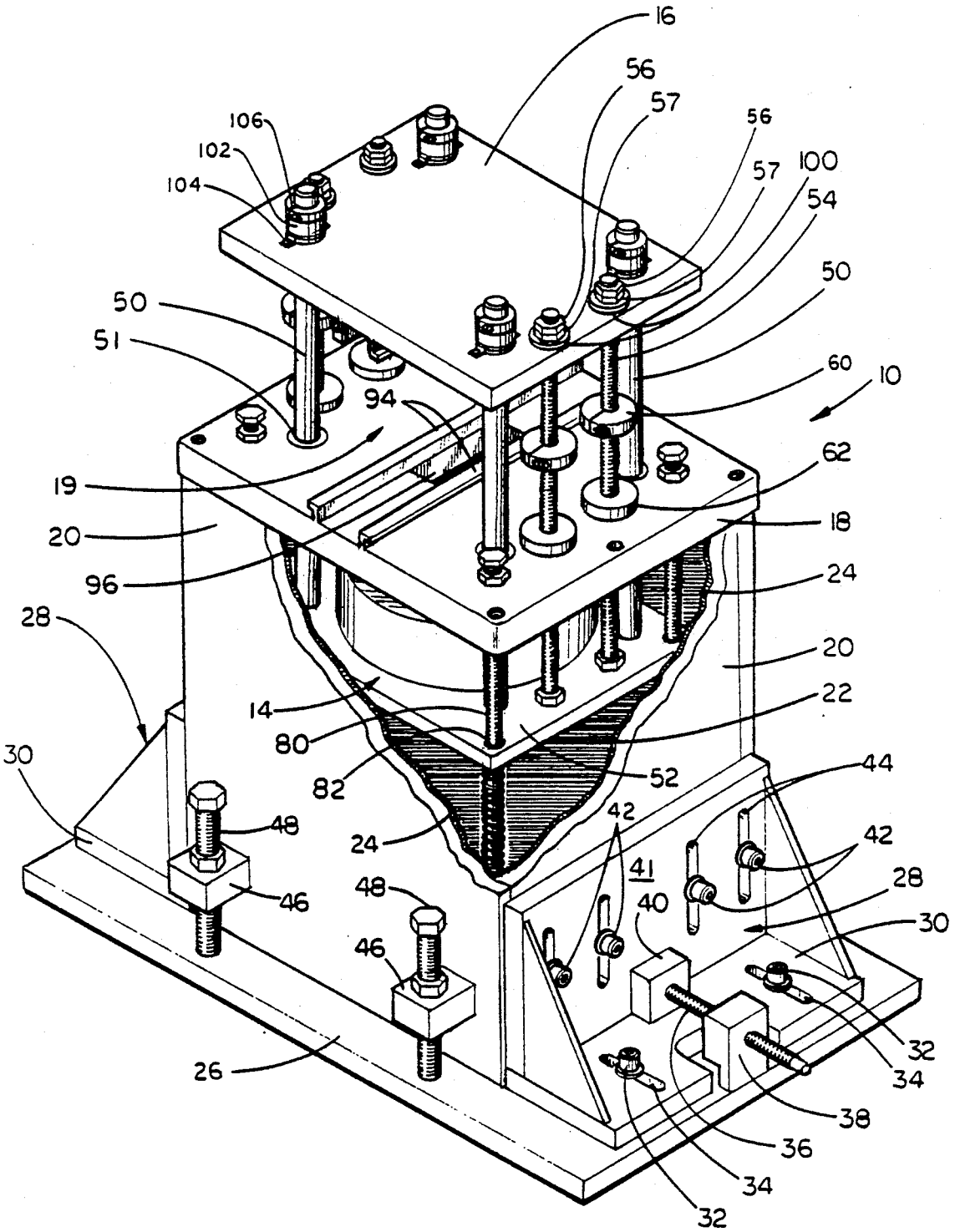
FIG. 1 is an isometric view of a pneumatic press constructed in accordance with the present invention.

FIG. 1 shows a form of a pneumatic press 10 constructed in accordance with the present invention. The press 10 comprises generally a stationary base 12 having a ram assembly 14 disposed for reciprocating movement relative thereto. An upper plate 16 or press plate on the ram assembly 14 is spaced vertically above a work plate 18 on the base 12, defining thereby a die-set area 19.

Figure 2:
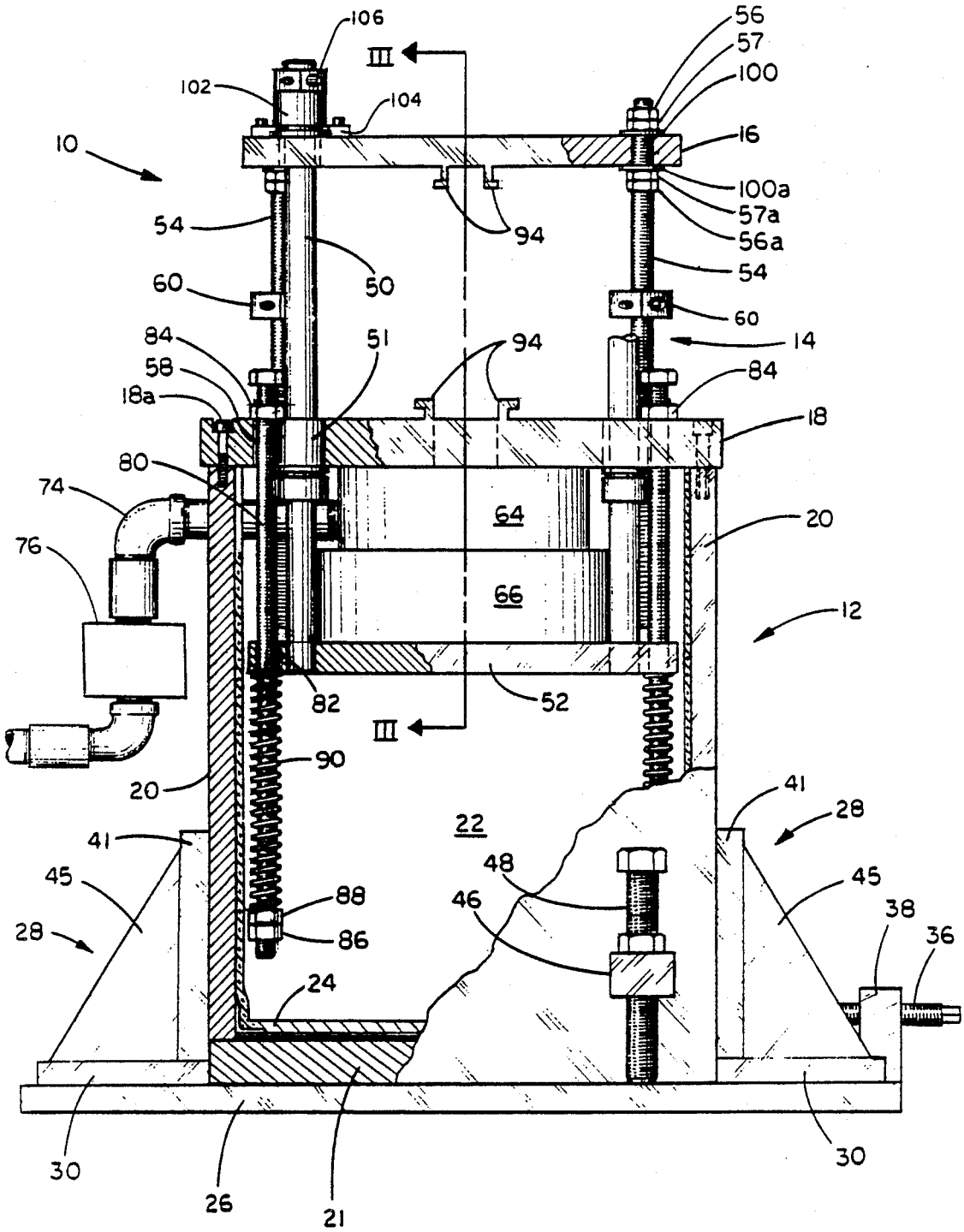
FIG. 2 is an elevational view, partly in cross section, of the pneumatic press of FIG. 1.

Referring now to FIGS. 1 and 2, the base 12 comprises a plurality of side walls 20 securely mounted to a base plate 21. The work plate 18 is securely fixed to the side walls 20 by bolts 18*a*. The base 12 thus defines a hollow chamber 22. Sound-deadening insulation 24 is provided within the chamber 22 on the surface of the side walls 20. The base 12 is movably mounted to a foundation plate 26 so that the vertical and horizontal position of the work plate 18 relative to the foundation plate 26 may be adjusted.

The base 12 is positioned on the foundation plate 26 between a pair of brackets 28. Each bracket comprises a bracket base plate 30 which is adjustably secured to the foundation plate 26 by hold-down screws 32 extending through elongated slots 34 in the base plate 30. A threaded drive rod 36 is journaled into a pillow block 38 and against a drive plate 40. It will be apparent that when the hold-down screws 32 are loosened, rotation of the threaded drive rod 36 will cause the bracket 28 to slidably move relative to the foundation plate 26.

A back plate 41 extends upwardly from the bracket base plate 30, and is adjustably secured to a side wall 20 of the base 12 by means of bolts 42 extending through elongated slots 44. Each bracket is reinforced by a pair of gussets 45 extending between the back plate 41 and the base plate 30. It will be apparent that a bracket 28 is mounted to opposite sides of the base 12, thus providing secure mounting of the base to the foundation plate 26, while also permitting lateral adjustment of the base relative to the foundation plate by means of the threaded drive rods 36.

Tabs 46 extending laterally outwardly from opposed side walls 20 of the base 12 carry jack screws 48 which bear against the foundation plate 26 to permit the base 12 to be adjusted vertically with respect to the foundation plate. It will be apparent that when the bolts 42 are loosened, and the jack screws 48 are tightened, the work plate 18 may be raised relative to the foundation plate 26 as far as the limits of the elongated slots 44 permit.

The ram assembly 14 includes four vertical guideposts 50 which depend from the upper plate 16, adjustably fixed thereto. A bushing 102 is press fit onto the end of each guidepost 50 extending above the plate 16 and fixed to the plate by toe clamps 104. A locking split collar 106 further secures the bushing 102 to the post 50. The posts 50 extend through bushings 51 in the work plate 18. The bushings 51 maintain a close tolerance relative to the diameter of the guideposts 50 so that when the guideposts are slidably received therein, they generally maintain the upper plate 16 parallel with the work plate 18. Further, the lower end of each guidepost 50 extends into the interior of the chamber 22. The lower ends of the guideposts 50 are secured to a cylinder plate 52 within the chamber 22 which is spaced below the work plate 18 and maintained generally parallel thereto. Thus, the upper plate 16 and the cylinder plate 52 are free to reciprocate relative to the work plate 18 as a single unit. Also extending between the upper plate 16 and the cylinder plate 52 and spaced laterally from the vertical guideposts 50 are four threaded rods 54. Each threaded rod 54 is secured to the upper plate 16 by an adjustment nut 56, a locknut 57, and a washer 100 above the plate 16 and extends through a clearance hole 58 in the work plate 18. Preferably, corresponding adjustment nuts 56*a*, locking nuts 57*a* and washers 100*a* are disposed on the rods 54 beneath the upper plate 16. Threaded collets 60 are disposed on each threaded rod and act as stops to limit the downward travel of the ram assembly 14 relative to the work plate 18. Preferably, a rubber bumper 62 surrounds each threaded rod and abuts the upper surface of the work plate 18 to absorb the impact of the downward movement of the upper plate 16.

A piston 64 is rigidly secured to the underside of the work plate 18, thereby disposed within the chamber 22. A cylinder 66 is rigidly secured to the upper surface of the cylinder plate 52 and telescopically received over the piston 64 for reciprocating movement relative thereto.

Figure 3:
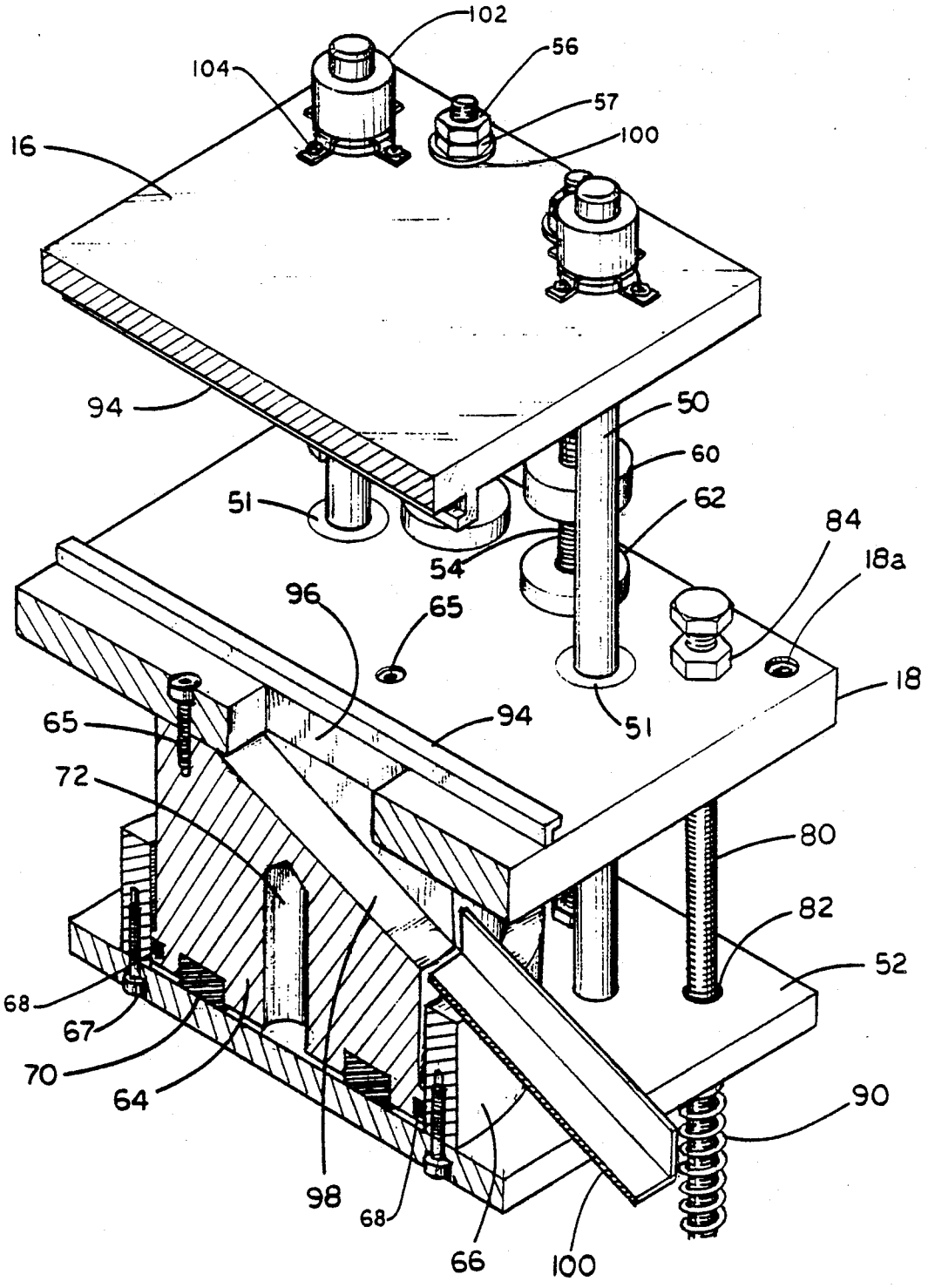
FIG. 3 is an isometric cross-sectional view of the pneumatic press taken along line 3—3 of FIG. 2.
Figure 4:
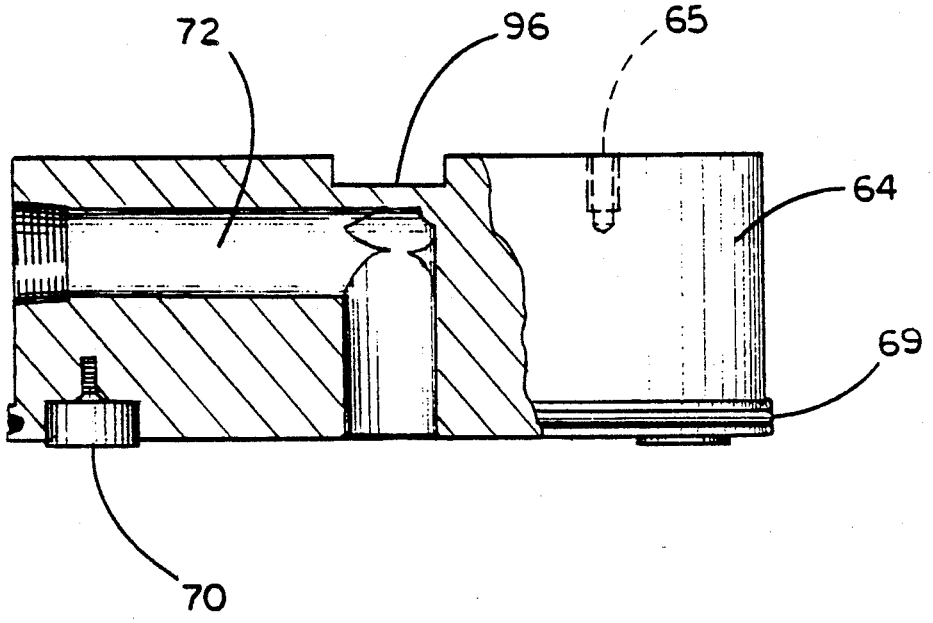
FIG. 4 is an enlarged, partially cross-sectional view of the piston utilized therein.

Referring now to FIGS. 3 and 4, it will be apparent that the piston 64 is secured to the work plate 16 by bolts 65 and the cylinder 66, similarly, is secured to the cylinder plate 52 by bolts 67. An O-ring 68 is disposed in an annular groove 69 at a lower end of the piston to form a seal between the piston and the cylinder. The length of the cylinder 66 is less than the length of the piston 64 so that the head of the piston acts as a stop against the upward movement of the cylinder plate 52 and hence the ram assembly 14. Resilient pads 70 are secured to the head of the piston 64 to absorb the impact of the upward movement of the ram assembly 14. A bore 72 extends radially from the side of the piston to the interior thereof, and thence downwardly to the head of the piston to serve as an air channel for the delivery of pressurized air to the cylinder plate 52.

Referring again to FIG. 2, a conduit 74 is connected to the bore 72 to deliver air to the piston from a pressurized source (not shown). A quick-exhaust, solenoid-operated air pilot valve 76, of the type manufactured and sold under the trade name MAC®, is provided between the source and the conduit 74 to intermittently deliver air to the cylinder in a manner hereinafter described.

As shown in FIGS. 1, 2 and 3, a plurality of threaded rods 80 depend from the work plate 18 through clearance holes 82 in the cylinder plate 52 into the interior of the chamber 22. Each rod 80 may be threaded through the work plate 18, or alternatively through a nut 84, bearing against the upper surface of the work plate 18. In this manner, the length of the rod 80 extending into the chamber beneath the cylinder plate 52 may be adjusted. An adjustment nut 86 and a lock nut 88 are threaded onto the lower end of each rod 80, each lock nut 88 serving also as a retainer or retaining means for a spring 90 carried on each rod between the lock nut 88 and the underside of the cylinder plate 52. In this manner, the cylinder plate 52 and thus the ram assembly 14 is biased upwardly with respect to the work plate 18. The tension of the springs 90, and thus the force which biases the upper plate 16 away from the work plate 18, is adjusted by rotation of the threaded rods 80.

Die tracks 94 are provided on the upper plate 16 and the work plate 18 to secure a die set in conventional manner within the die-set area 19. In order to remove slugs from the die-set area 19, a slug clearance hole 96 is provided in the work plate 18. A groove 98 in the piston 64 is located immediately adjacent the slug clearance hole 96 so as to be in communication therewith. It will be apparent that the groove is sloped from the clearance hole 96 radially toward the side of the piston 64 and will connect to a slug chute 100 extending from the side of the piston through a side wall 20 of the base 12.

In operation, a conventional stamping die set is installed in the die-set area in a manner well known in the art. If necessary, the upper plate 16 may be adjusted upwardly relative to the work plate 18 to permit sufficient clearance for the die set. The downward stroke of the upper plate 16 is adjusted by rotating the collets 60 on rods 54. Pressurized air flows from the source (not shown) through control valve 76, air conduit 74, and bore 72 to impact the cylinder plate 52 causing the cylinder plate to move downwardly against the bias of the springs 90. Downward movement of the cylinder plate 52 causes a simultaneous downward movement of the upper plate 16 via the guide rods 50 and the threaded rods 54. The downward movement of the upper plate 16 causes the die set to compress in conventional manner, stamping the desired piece, and causing a slug to fall through the clearance hole 96, through the groove 98 and exit through the slug chute 100. As the ram assembly 14 reaches the downward limit of its stroke as defined by the collets 60, the control valve 76 is switched to cause air to exhaust from the cylinder, thus permitting the spring bias to return the ram assembly 14 to the upper limit of its stroke as defined by the cylinder 16 impacting the head of the piston 64. Typically, the valve 76 is controlled electrically from a separate control circuit. Such control technology is well known in the art and forms no part of the present invention. The ram assembly 12 is then ready for another downstroke upon repressurization of the cylinder. This repetitive compressing of the die set may occur at rates of approximately 600 strokes per minute.

It will be apparent that the invention provides significant advantages over the prior art by placing the piston and the cylinder below the work plate, and encasing the driving mechanism in an enclosed, sound-deadening chamber. The pneumatic assembly and the biasing means within an insulated housing. The press thus as a low profile, and operates much quieter than conventional air presses. The safety factor is increased by encasing the pneumatic portion of the ram assembly and the return springs in the base. The press is also easier to maintain in the event that a work piece becomes jammed in the die set because the upper plate 16 is easily removable to provide access to the die-set area without having to remove cumbersome and bulky equipment mounted above the upper plate. Further, access to the pneumatic mechanism within the chamber is easily provided by removing the work plate from the base. The entire ram assembly can thus be removed as a unit for service and repair.

It will be further understood that reasonable variation and modification of the invention may be accomplished without departing from the scope and spirit of the invention as defined in the accompanying claims.

The embodiments of the invention in which an exclusive property or privilege is claimed are defined as follows:

1. A fluid-operated press for continual stamping comprising:

a bed plate having an aperture, a discharge hole, a first surface, and a second surface opposite the first surface;

a press plate spaced from the first surface and defining a die-set area therewith;

spring means biasing the press plate away from the first surface;

pneumatically operated means for urging the press plate toward the first surface, said pneumatically operated means including a piston mounted to the second surface and a cylinder telescopically received over the piston for reciprocating movement relative thereto;

said piston having an inclined groove in communication with the discharge hole, said groove sloping away from the discharge hole radially of the piston; and link means connecting the cylinder to the press plate, said link means comprising a rod connected at one end to the press plate and at another end to the cylinder, said rod extending through the aperture, whereby upon introduction and exhaust of pressurized fluid to the cylinder, the cylinder is thereby urged away from and toward, respectively, the second surface, and the press plate is urged toward and away from, respectively, the first surface to repetitively compress a die set positioned in the die-set area.

2. A fluid-operated press according to claim 1 further comprising a base for supporting the bed plate, said base having walls substantially defining a chamber therewithin, and said pneumatically operated means being mounted within the chamber.

3. A fluid-operated press according to claim 2 further comprising sound-deadening means for damping sound emanating from the chamber when the pressurized fluid is alternately introduced to and exhausted from the pneumatically operated means.

4. A fluid-operated press according to claim 3 wherein the sound-deadening means comprises insulation adjacent interior surfaces of the walls.

5. A fluid-operated press according to claim 1 wherein the rod is threaded and the connection between the rod and the press plate comprises a nut and locknut so that the position of the press plate may be adjusted relative to the cylinder.

6. A fluid-operated press according to claim 5 wherein the cylinder has an end wall which extends beyond the radius of the cylinder wall, and the rod is connected to the end wall.

7. A fluid-operated press according to claim 1 wherein a stop member is mounted to the rod between the bed plate and the press plate to stop movement of the press plate by contacting the first surface as the press plate is urged toward the first surface.

8. A fluid-operated press according to claim 7 wherein the stop member comprises a collet threaded onto the rod.

9. A fluid-operated press according to claim 7 wherein a shock absorbing damper is provided on the first surface to absorb the impact of the stop member.

10. In a fluid-operated press comprising a bed plate having a work surface and a second surface opposite the work surface, a press plate spaced from the work surface and defining a die-set area therewith, a pneumatically operated means for urging the press plate toward the work surface, and spring means biasing the press plate away from the work surface, the improvement comprising:

a base for supporting the bed plate, said base having walls substantially defining a chamber therewith, and said bed plate having an aperture and a discharge hole;

the pneumatically operated means being mounted within the chamber and operably connected to the press plate, said pneumatically operated means including a piston mounted to the second surface and a cylinder telescopically received over the piston for reciprocating movement relative thereto;

said piston having an inclined groove in communication with the discharge hole radially of the piston;

link means connecting the cylinder to the press plate, the link means comprising a rod connected at one end to the press plate and at another end to the cylinder, said rod extending through the aperture; and sound deadening means for damping sound emanating from the chamber when pressurized fluid is alternately introduced to and exhausted from the pneumatically operated means.

11. A fluid-operated press according to claim 10 wherein the piston includes a first channel in communication with the cylinder whereby upon introduction and exhaust of pressurized fluid to the cylinder, the cylinder is thereby urged away from and toward, respectively; the second surface, and the press plate is urged toward an away from, respectively, the work surface to repetitively compress a die set positioned in the die-set area.

12. A fluid-operated press according to claim 10 wherein the rod is threaded and the connection between the rod and the press plate comprises a nut and locknut so that the position of the press plate may be adjusted relative to the cylinder.

13. A fluid-operated press according to claim 12 wherein the cylinder has an end wall which extends beyond the radius of the cylinder wall, and the rod is connected to the end wall.

14. A fluid-operated press according to claim 10 wherein a stop member is mounted to the rod between the bed plate and the press plate to stop movement of the press plate by contacting the first surface as the press plate is urged toward the first surface.

15. A fluid-operated press according to claim 14 wherein the stop member comprises a collet threaded onto the rod.

16. A fluid-operated press according to claim 14 wherein a shock absorbing damper is provided on the first surface to absorb the impact of the stop member.

17. In a fluid-operated press comprising a bed plate having a work surface, a press plate spaced from the work surface and defining a die-set area therewith, pneumatically operated means for urging the press plate toward the work surface, and spring means biasing the press plate away from the work surface, the improvement comprising:

a base for supporting the bed plate, said base having walls substantially defining a chamber therewithin;

a guide pin having one end fixedly mounted to the bed plate and a second extending into the chamber, a retaining means being mounted to the second end;

a member slidably mounted to the guide pin and operably connected to the press plate for movement therewith reciprocally relative to the guide pin, the spring means being mounted to the guide pin between the retaining means and the member to urge the member away from the retaining means, and thereby urge the press plate away from the work surface.

18. A fluid-operated press according to claim 17 wherein the bed plate has a second surface opposite the work surface, and a piston is mounted to the second surface and a cylinder is telescopically received over the piston for reciprocating movement relative thereto.

19. A fluid-operated press according to claim 18 wherein a link connects the cylinder to the press plate.

20. A fluid-operated press according to claim 19 wherein the link comprises a rod connected at one end of the press plate and at another end of the cylinder and the rod extends through an aperture in the bed plate.

21. A fluid-operated press according to claim 20 wherein the rod is threaded and the connection between the rod position of the press plate may be adjusted relative to the cylinder.

22. A fluid-operated press according to claim 21 wherein the cylinder has an end wall which extends beyond the radius of the cylinder wall, and the rod is connected to the end wall.

23. A fluid-operated press according to claim 20 wherein a stop member is mounted to the rod between the bed plate and the press plate to stop movement of the press plate by contacting the work surface as the press plate is urged toward the work surface.

24. A fluid-operated press according to claim 23 wherein the stop member comprises a collet threaded onto the rod.

25. A fluid-operated press according to claim 23 wherein a stock absorbing damper is provided on the work surface to absorb the impact of the stop member.

* * * * *

UNITED STATES PATENT AND TRADEMARK OFFICE

CERTIFICATE OF CORRECTION

PATENT NO. : 5,062,357

DATED : November 5, 1991

INVENTOR(S) : ROBERT B. SENIOR and EDWARD L. HVIZDOS

It is certified that error appears in the above-identified patent and that said Letters Patent is hereby corrected as shown below:

Col. 6, claim 10, line 48:
"therewith" should be --therewithin--.

Col. 6, claim 10, line 59:
after "hole" insert --, said groove sloping away from the discharge hole--.

Col. 7, claim 11, line 2:
"first" should be --fluid--.

Col. 8, claim 21, line 26:
after "rod" insert --and the press plate comprises a nut and locknut so that the--.

Signed and Sealed this

Sixth Day of April, 1993

*Attest:*

STEPHEN G. KUNIN

*Attesting Officer*

*Acting Commissioner of Patents and Trademarks*